United States Patent [19]

Hults

[11] 3,959,617

[45] May 25, 1976

[54] CONDUCTIVE LUBRICANT IN SWITCH ACTUATOR PIVOT FOR RFI ELIMINATION

[75] Inventor: Harold W. Hults, New Berlin, Wis.

[73] Assignee: Cutler-Hammer, Inc., Milwaukee, Wis.

[22] Filed: Jan. 15, 1975

[21] Appl. No.: 541,094

[52] U.S. Cl. ..... 200/305; 200/329; 200/153 G

[51] Int. Cl.[2] ..... H01H 9/06

[58] Field of Search ..... 200/153 G, 302, 309, 200/305, 329, 335

[56] References Cited

UNITED STATES PATENTS 3,041,430 6/1962 Hults ..... 200/302

3,566,064 2/1971 Neillis ..... 200/305

*Primary Examiner*—Gerald P. Tolin

*Attorney, Agent, or Firm*—H. R. Rather; Wm. A. Autio

[57] ABSTRACT

RFI (radio frequency interference) is eliminated by placing conductive grease between the toggle lever and its pivot pin in an electric switch to insure good connection of the toggle lever to ground through the housing. This conductive grease also prevents any tendency for the rubber seal material forcing its way into the space between the pivot pin and the toggle lever during the in situ molding operation which otherwise might insulate the toggle lever and cause RFI radiation due to its antenna effect.

5 Claims, 3 Drawing Figures

CONDUCTIVE LUBRICANT IN SWITCH ACTUATOR PIVOT FOR RFI ELIMINATION

BACKGROUND OF THE INVENTION

Sealed toggle lever switches have been known heretofore. For example, my prior U.S. Pat. No. 3,041,430, dated June 26, 1962, shows an electric switch having a molded-in toggle lever seal. However, these prior switches have had the disadvantage in certain applications of RFI radiation due to the antenna effect of toggle levers. In some instances, this might be enhanced by the tendency for the seal material to force its way into the space between the pivot pin and the toggle lever during the in situ molding operation, thus insulating the toggle lever from the grounded housing. Attempts have been made to solve this problem by placing a radiation shield of wire mesh or the like over the toggle lever. However, this creates a cumbersome structure that interferes with its utility and appearance. While these prior switches have been useful for their intended purpose, this invention relates to improvements thereover.

SUMMARY OF THE INVENTION

This invention relates to electric switches and more particularly to elimination of the RFI (radio frequency interference) problem in connection therewith.

An object of the invention is to provide an improved electric switch.

A more specific object of the invention is to provide an electric switch with improved means to avoid RFI radiation therefrom.

Another specific object of the invention is to provide a toggle switch with improved means for eliminating RFI by insuring that the toggle lever is electrically grounded within proper ohmic limits.

Another specific object of the invention is to provide a toggle switch with improved means for eliminating RFI by applying conductive grease between the toggle lever and its pivot pin.

Other objects and advantages of the invention will hereinafter appear.

DESCRIPTION OF THE BEST MODE

Figure 1:
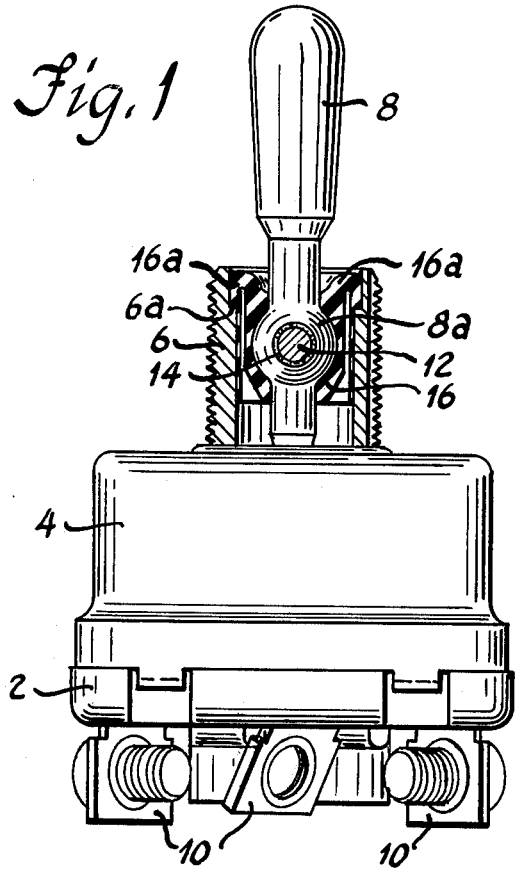
FIG. 1 is an enlarged front elevational view of a lever-sealed toggle switch, partly in section, showing the pivot pin on a plane transverse thereto and the conductive grease around this pin.
Figure 2:
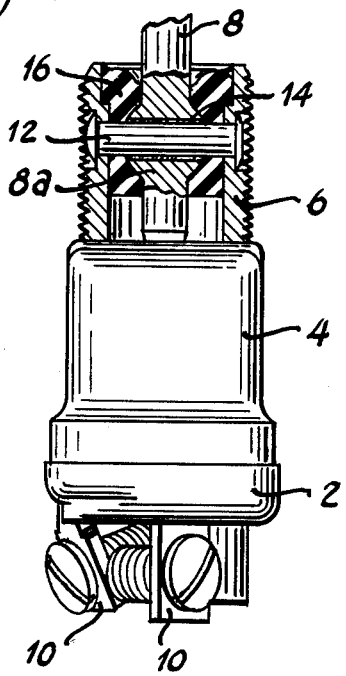
FIG. 2 is an end elevational view of the switch of FIG. 1, partly in section, showing the conductive grease on a plane along the axis of the pivot pin.
Figure 3:
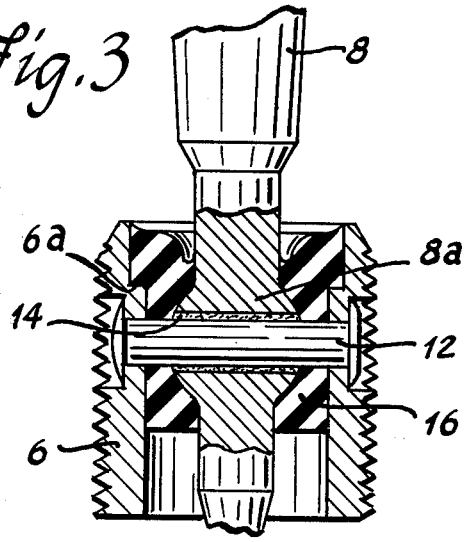
FIG. 3 is an enlarged view of the upper portion of FIG. 2 more clearly to show the conductive grease between the toggle lever and its pivot pin.

Referring to FIGS. 1-3, there is shown a toggle switch including conductive grease in the switch actuator pivot for RFI elimination constructed in accordance with the invention. As shown therein, the switch is provided with an insulating base 2 to which is attached a metal housing 4 having a threaded bushing 6 extending up therefrom for pivotally supporting a toggle lever 8. A plurality of terminals 10 extend down through the bottom of the base and are connected to stationary contacts within the switch compartment. The switch mechanism within the housing is similar to that shown in my aforementioned U.S. Pat. No. 3,041,430.

The toggle lever is supported in the bushing by a pivot pin 12. As shown in FIG. 3, this pivot pin extends through holes in opposite sides of the bushing and through a hole in the enlarged spherical portion of the toggle lever. The outer surfaces of the bushing around these holes are recessed so that when the pivot pin is riveted therein, it will clear the threads of a nut that is threaded on the bushing in attaching the switch to a panel.

To prevent radio frequency interference from being radiated, the toggle lever must be grounded. To insure that the toggle lever does not become insulated from its pivot pin, electrically conductive grease 14 is applied to fill the space within the hole in the toggle lever around the pivot pin. This grease may be of the silver or carbon-filled silicone type or the like having a volume resistivity of $10^{-2}$ ohm-cm or less. This grease functions not only as a lubricant but also as an electrical conductor. It can be made by using dispersions of micron-size metal particles in the lubricant. The metal particles must be segregated to an optimum size and particle shape and, if made of copper, must be subsequently plated to prevent surface oxidation and to provide low electrical contact resistance between particles. If the particles are made of good contact material like silver as aforementioned, no plating is required.

A lever seal 16 is molded in situ after the parts have been assembled along with the conductive grease on the pivot pin. This seal closes the opening in the bushing while allowing freedom of pivotal movement of the toggle lever. This lever seal may be composed of an elastic rubber-like material such as silicone rubber, or the like. This seal is molded in place between bushing 6 and toggle lever 8 around pivot pin 12 so as to surround the spherical portion **8*a* of the lever and part of the shank above and below it. This seal is substantially circular or cylindrical and has an axial opening therethrough. As shown in FIG. 1, this seal has a substantially U-shaped cross-section 16*a* through opposite sides thereof in the plane transverse to pivot pin 12 and extending in opposite directions from this plane toward the opposite ends of the pivot pin to a point short of the pivot pin wherein the seal surrounds and covers the pivot pin as shown in FIGS. 2 and 3. This seal cross-section, on each side as shown in FIG. 1, has an outer depending leg portion having an outer peripheral surface sealed to the upper inner surface within bushing 6, and a longer inner leg portion having an inner substantially cylindrical surface sealed to the toggle lever with a space between the two leg portions to afford freedom of movement. The lower end of the outer leg portion is confined against a shoulder 6*a*** formed by a single step of increased inside diameter near the top of the bushing, and the inner leg portion is sealed to the toggle lever around the enlarged spherical portion thereof.

As seen by reference to FIGS. 2 and 3, the space between the outer short leg portion and the inner long leg portion of the seal does not extend all the way around the bushing but is filled up at the portions where the pivot pin passes through the bushing to seal the opening in the bushing through which the pivot pin passes.

The conductive grease fills the space between the toggle lever and its pivot pin and prevents any tendency of the seal material to force its way into the space between the pivot pin and the toggle lever during the in situ molding operation. Thus, the conductive grease maintains the toggle lever electrically grounded to the metal housing to prevent radiation of RFI therefrom.

While the apparatus hereinbefore described is effectively adapted to fulfill the objects stated, it is to be understood that the invention is not intended to be confined to the particular preferred embodiment of conductive molded-in toggle lever seal for an electric switch disclosed, inasmuch as it is susceptible of various modifications without departing from the scope of the appended claims.

I claim:

1. An electric switch comprising:

a switch housing at least partly of metal having an opening therein and normally being grounded in use;

a metal switch actuator extending out through said opening so as to be accessible for operation to actuate the switch;

a metal mounting member engaging said actuator and secured to said metal part of said housing for supporting said actuator for operation;

and electrically conductive lubricant between said actuator and said mounting member insuring a good electrical connection of said actuator to said housing to prevent RFI radiation therefrom.

2. The electric switch defined in claim 1, wherein:

said conductive lubricant is a grease having particles of good electrically conductive material dispersed therethrough.

3. The electric switch defined in claim 1, wherein:

said conductive lubricant is a silicone grease having silver particles dispersed therethrough.

4. An electric switch comprising:

a switch housing having a metal bushing thereon adapted to be secured to a mounting panel and thereby grounded;

a metal toggle lever extending out through said bushing so as to be accessible for pivotal actuation to operate the switch;

a metal pin extending through said toggle lever and secured to said bushing to pivotally support the latter in said bushing;

a molded-in resilient seal sealing the space between said toggle lever and said bushing around said pivot pin;

and conductive grease in the space between said pivot pin and said toggle lever preventing the seal material from being forced thereinto during its molding operation and insuring a good electrical connection of said toggle lever to said bushing to prevent RFI radiation therefrom.

5. The electric switch defined in claim 4, wherein:

sand conductive grease comprises a silicone binder having high electrical conductivity particles dispersed therethrough to provide a volume resistivity of $10^{-2}$ or less.

* * * * *